US011584896B2

(12) United States Patent
Han et al.

(10) Patent No.: US 11,584,896 B2
(45) Date of Patent: *Feb. 21, 2023

(54) HYDROCARBON LUBRICANT COMPOSITIONS AND METHOD TO MAKE THEM

(71) Applicant: Dow Global Technologies LLC, Midland, MI (US)

(72) Inventors: Yaokun Han, Shanghai (CN); Martin R. Greaves, Baar (CH); Yong Zhao, Shanghai (CN); Cheng Shen, Shanghai (CN); Tao Wang, Shanghai (CN); Jieying Chen, Shanghai (CN)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/428,027

(22) PCT Filed: Mar. 5, 2019

(86) PCT No.: PCT/CN2019/077037

§ 371 (c)(1),
(2) Date: Aug. 3, 2021

(87) PCT Pub. No.: WO2020/177086

PCT Pub. Date: Sep. 10, 2020

(65) Prior Publication Data

US 2022/0119728 A1 Apr. 21, 2022

(51) Int. Cl.

| | |
|---|---|
| ***C10M 169/04*** | (2006.01) |
| ***C10M 145/38*** | (2006.01) |
| ***C10M 143/04*** | (2006.01) |
| ***C10M 143/14*** | (2006.01) |
| ***C10M 145/14*** | (2006.01) |
| ***C10M 157/00*** | (2006.01) |
| ***C10M 177/00*** | (2006.01) |
| *C10N 20/04* | (2006.01) |
| *C10N 30/02* | (2006.01) |
| *C10N 30/04* | (2006.01) |
| *C10N 70/00* | (2006.01) |

(52) U.S. Cl.

CPC ..... *C10M 169/041* (2013.01); *C10M 143/04* (2013.01); *C10M 143/14* (2013.01); *C10M 145/14* (2013.01); *C10M 145/38* (2013.01); *C10M 157/00* (2013.01); *C10M 177/00* (2013.01); *C10M 2203/003* (2013.01); *C10M 2205/024* (2013.01); *C10M 2205/08* (2013.01); *C10M 2209/084* (2013.01); *C10M 2209/109* (2013.01); *C10N 2020/04* (2013.01); *C10N 2030/02* (2013.01); *C10N 2030/04* (2013.01); *C10N 2070/00* (2013.01)

(58) Field of Classification Search

CPC ..... C10M 145/38; C10M 2209/109; C10M 169/041; C10M 143/04; C10M 143/14; C10M 145/14; C10M 157/00; C10M 2209/084; C10N 2030/02

See application file for complete search history.

(56) References Cited

U.S. PATENT DOCUMENTS

| | | | | |
|---|---|---|---|---|
| 2,620,304 | A | 12/1952 | Stewart et al. | |
| 2,620,308 | A | 12/1952 | Stewart et al. | |
| 4,968,453 | A * | 11/1990 | Wada | C10M 111/04 508/499 |
| 6,278,007 | B1 * | 8/2001 | Inaoka | C08G 65/3312 554/126 |
| 6,642,189 | B2 | 11/2003 | Kurihara et al. | |
| 7,208,543 | B2 | 4/2007 | Tanaglia | |
| 10,113,134 | B2 | 10/2018 | Khelidj et al. | |
| 11,279,897 | B2 * | 3/2022 | Han | C08G 65/332 |
| 11,396,638 | B2 * | 7/2022 | Greaves | C10M 169/041 |
| 2004/0198616 | A1 * | 10/2004 | Hirao | C10M 145/38 508/485 |
| 2007/0270320 | A1 | 11/2007 | Itou et al. | |
| 2010/0120639 | A1 * | 5/2010 | Thoen | C10M 111/04 508/516 |
| 2011/0294708 | A1 | 12/2011 | Narita | |

(Continued)

FOREIGN PATENT DOCUMENTS

| | | |
|---|---|---|
| EP | 2688993 | 1/2014 |
| GB | 711484 A | 7/1954 |
| JP | H7-305079 | 11/1995 |

OTHER PUBLICATIONS

PCT/CN2019/077037, International Search Report and Written Opinion dated Dec. 4, 2019.

*Primary Examiner* — Ellen M McAvoy

(57) ABSTRACT

A lubricant composition that comprises a hydrocarbon base oil, a polar viscosity improver; and an esterified polyalkylene glycol: $R^1[O(R^2O)_n(R^3O)_m(C{=}O)R^4]_p$, wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1, 2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4. The lubricant composition may have a viscosity index of at least 150, a kinematic viscosity at 100° C. from 2 to 5 centistokes and a kinematic viscosity at −20° C. of at most 600 centistokes.

20 Claims, No Drawings

(56) References Cited

U.S. PATENT DOCUMENTS

| | | | | |
|---|---|---|---|---|
| 2013/0157909 | A1* | 6/2013 | Greaves | C10M 105/14 508/513 |
| 2013/0165354 | A1 | 6/2013 | Deckman | |
| 2014/0249063 | A1 | 9/2014 | Greaves et al. | |
| 2014/0303053 | A1* | 10/2014 | Greaves | C10M 141/10 508/282 |
| 2015/0119303 | A1 | 4/2015 | Guerin et al. | |
| 2015/0275124 | A1* | 10/2015 | Greaves | C10M 169/041 508/579 |
| 2015/0337230 | A1* | 11/2015 | Delbridge | C10M 165/00 508/175 |
| 2016/0272916 | A1* | 9/2016 | Kashani-Shirazi | C08G 65/332 |
| 2017/0211009 | A1* | 7/2017 | Khelidj | C10M 145/32 |
| 2018/0148661 | A1* | 5/2018 | Lee | C10M 105/04 |
| 2018/0245016 | A1* | 8/2018 | Greaves | C10M 135/36 |
| 2018/0245017 | A1* | 8/2018 | Kotnis | C10M 169/044 |
| 2020/0318024 | A1 | 10/2020 | Han et al. | |
| 2020/0332217 | A1* | 10/2020 | Greaves | C10M 169/041 |

* cited by examiner

HYDROCARBON LUBRICANT COMPOSITIONS AND METHOD TO MAKE THEM

TECHNICAL FIELD

The present disclosure relates to improved hydrocarbon base oils having improved properties. More specifically hydrocarbon base oils having modified polyalkylene glycol compositions along with polar viscosity improvers are disclosed.

BACKGROUND

The majority of lubricants used today in equipment are manufactured using a hydrocarbon base oil. This is typically a mineral oil or a synthetic hydrocarbon oil (such as a polyalphaolefin). The American Petroleum Institute (API) has segmented hydrocarbon base oils into Group I, II, III and IV base oils based on their viscosity indices, saturate levels and sulphur levels.

Transportation lubricants such as engine lubricants are often formulated with API Group I-IV base oils. Research continues into developing more energy efficient lubricants. One way to achieve this is to use lubricants with lower overall viscosity, but sufficient viscosity to maintain lubricity (low friction) and low wear. Lower viscosity lubricants often use lower viscosity base oils. For base oils of the same chemical family (e.g. API Group IV polyalphaolefins), lower viscosity base oils typically have lower viscosity index values. In addition there is a need for lubricants having a higher viscosity index (VI). Group IV base oils (synthetic polyalphaolefins, PAO) typically have the highest VI values of all the API Group I-IV base oils, but are expensive. Group III base oils are still expensive but generally have higher VI values than Groups I and II base oils.

Viscosity indices are a measure of how much the viscosity of an oil changes over a temperature range. It is derived from a calculation based on the kinematic viscosity at 40° C. and 100° C. using ASTM D2270. Higher viscosity index values correspond to less change in viscosity over this temperature range. Lubricants having a high viscosity index are desirable so as to maintain a more consistent viscosity over a broad temperature range. For example in an automotive engine if the oil viscosity becomes too high, then fuel efficiency decreases. If the oil viscosity becomes too low, excessive engine wear can occur. Fluids that show only minor changes in viscosity (i.e, they have a high viscosity index) across this temperature range are desirable.

Viscosity index improvers are additives that tend to reduce the change in oil viscosity over a temperature range. Typical viscosity index improvers include, for example, polyalkylmethacrylates and olefin copolymers. Unfortunately, while viscosity index improvers can increase the viscosity index of engine oil, they almost always significantly increase the viscosity of the engine oil at low temperature (e.g., 0° C., −10° C. or −20° C.). Low temperature viscosity is important to consider when starting an engine in low temperature environments. While it is important for an engine oil to form a film that is viscous enough to prevent wear in order to protect engine components, it is also important that the engine oil is not so viscous so as to cause high frictional losses due to excessive viscous drag from the oil. Therefore, it is highly desirable to find lubricants or additives or co-base fluids which also reduce low temperature viscosity (e.g., at 0° C. or even −20° C.). Illustratively, the industry desires a lubricating oil to have a VI of about 150 or greater, viscosity of between about 2 and 5 centistokes at 100° C. and a viscosity at −20° C. of less than 1000 centistokes and preferably less than 500 or even 400 centistokes.

It would be desirable to provide a hydrocarbon lubricant base oil with improved characteristics such as VI index with low viscosity at low temperatures.

SUMMARY

The invention described herein realizes a hydrocarbon lubricant composition comprised of a modified Oil-Soluble Polyalkylene Glycol (OSP) and a polar viscosity improver that surprisingly improves the VI while enabling a decreased low temperature viscosity while maintaining a desired high temperature viscosity.

A first aspect of the invention is a lubricant composition, comprising:

a hydrocarbon base oil;

a polar viscosity improver (PVI); and an esterified polyalkylene glycol:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4. The lubricant formulation is preferably used with internal combustion engines The present disclosure further includes embodiments of the lubricant formulation in which $R^3O$ is derived from 1,2-butylene oxide. Other preferred values include where $R^4$ is a linear alkyl with 1 to 8 carbon atoms. Preferably, $R^1$ is a linear alkyl with 10 to 14 carbon atoms.

A second aspect of the invention is a method of forming a lubricant composition comprising:

(i) dissolving, first, a polar viscosity improver into an esterified polyalkylene glycol represented by the following structure:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4, to form a solution of the polar viscosity improver and esterified polyalkylene glycol, and then (ii) admixing a base hydrocarbon oil with the solution of the viscosity improver and esterified polyalkylene glycol to form the lubricant composition, wherein said lubricant composition is a homogeneous solution.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

The present disclosure provides for lubricants comprised of a hydrocarbon base oil, an esterified oil soluble polyalkylene glycol (E-OSP) and polar viscosity improver that surprisingly improves the VI, while not increasing the viscosity at low temperature and in some instances reducing said viscosity. In particular combinations, lubricating oils that have surprisingly good combinations of VI and low temperature properties may be formed that are particular useful as internal combustion motor oils The lubricant composition is comprised of an esterified oil-soluble polyalkylene glycol (E-OSP) of Formula I:

$$R^1[O(R^2O)_n(R^3O)_m(C{=}O)R^4]_p \qquad \text{Formula I}$$

$R^1$ is a linear alkyl having 1 to 18 carbon atoms, a branched alkyl having 4 to 18 carbon atoms or an aryl with 6 to 30 carbon atoms. Preferably, $R^1$ is a linear alkyl with 10 to 14 carbon atoms. $R^2O$ is an oxypropylene moiety derived from 1,2-propylene oxide, where the resulting structure of $R^2O$ in Formula I can be either [—$CH_2CH(CH_3)$—O-] or [—$CH(CH_3)CH_2$—O—]. $R^3O$ is an oxybutylene moiety derived from butylene oxide, where the resulting structure of $R^3O$ in Formula I can be either [—$CH_2CH(C_2H_5)$—O-] or [—$CH(C_2H_5)CH_2$—O-] when $R^3O$ is derived from 1,2-butylene oxide. When $R_3O$ is derived from 2,3 butylene oxide the oxybutylene moiety will be [—$OCH(CH_3)CH(CH_3)$—]. For the various embodiments, $R^2O$ and $R^3O$ are in a block or a random distribution in Formula I. $R^4$ is a linear alkyl with 1 to 18 carbon atoms, a branched alkyl with 4 to 18 carbon atoms or an aryl with 6 to 18 carbon atoms. Preferably, $R^4$ is a linear alkyl with 1 to 8 carbon atoms. The values for n and m are each independently integers ranging from 0 to 20, where n+m is greater than 0. The value for p is an integer from 1 to 4.

The E-OSP of the present disclosure can have one or more properties that are desirable for various lubricant applications. For instance, viscosity index is a measure of how the viscosity of the lubricant changes with temperature. For lubricants, relatively lower viscosity index values can indicate a greater reduction in a lubricant's viscosity at higher temperatures, as compared to a lubricant having a relatively higher viscosity index value. As such, for a number of applications, relatively higher viscosity index values are advantageous so that the lubricant maintains a generally steady viscosity with less pronounced viscosity changes for extremes of temperatures that go from lower temperatures to higher temperatures. The E-OSP disclosed herein can provide higher viscosity index values in combination with particular polar viscosity improvers in hydrocarbon base oils.

The E-OSPs disclosed herein have a low viscosity as they have a kinematic viscosity at 40° C. of less than 25 centistokes (cSt) and a kinematic viscosity at 100° C. of 6 cSt or less (both kinematic viscosities measured according to ASTM D7042). The E-OSPs may have a kinematic viscosity, as determined by ASTM D7042, at 40° C. from a lower limit 8.0 or 9.0 cSt to an upper limit of 24.5 or 24.0 cSt. The E-OSPs may have a kinematic viscosity, as determined by ASTM D7042, at 100° C. from a lower limit 1.0 or 2.5 cSt to an upper limit of 6.0 or 5.5 cSt. As mentioned, the E-OSPs disclosed advantageously provide relatively lower viscosities at low temperatures in combination with polar viscosity improver, as compared to other lubricants, such as ones containing similar non-esterified oil soluble polyalkylene glycols. Additionally, low viscosity lubricants having a relatively lower viscosity, e.g., kinematic and/or dynamic, at low temperatures, such as at or below 0° C., can advantageously help to provide lower energy losses, such as when pumping the lubricant around an automotive engine. The esterified oil soluble polyalkylene glycols disclosed herein can provide relatively lower viscosities e.g., kinematic and/or dynamic, at low temperatures, as compared to some other lubricants.

The E-OSP of Formula I is a reaction product of an oil soluble polyalkylene glycol and an acid. Unlike mineral oil base oils, oil soluble polyalkylene glycols have a significant presence of oxygen in the polymer backbone. Embodiments of the present disclosure provide that oil soluble polyalkylene glycols are alcohol initiated copolymers of propylene oxide and butylene oxide, where units derived from butylene oxide are from 50 weight percent to 95 weight percent based upon a total of units derived from propylene oxide and butylene oxide. All individual values and subranges from 50 weight percent to 95 weight percent are included; for example, the oil soluble polyalkylene glycol may have units derived from butylene oxide from a lower limit of 50, 55, or 60 weight percent to an upper limit of 95, 90, or 85 weight percent based upon the total of units derived from propylene oxide and butylene oxide. For the various embodiments, the propylene oxide can be 1,2-propylene oxide and/or 1,3-propylene oxide. For the various embodiments, the butylene oxide can be selected from 1,2-butylene oxide or 2,3-butylene oxide. Preferably, 1,2-butylene oxide is used in forming the oil soluble polyalkylene glycol.

The alcohol initiator for the oil soluble polyalkylene glycol may be a monol, a diol, a triol, a tetrol, or a combination thereof. Examples of the alcohol initiator include, but are not limited to, monols such as methanol, ethanol, butanol, octanol and dodecanol. Examples of diols are ethylene glycol, 1,2-propylene glycol, 1,3-propylene glycol and 1,4 butanediol. Examples of triols are glycerol and trimethylolpropane. An example of a tetrol is pentaerythritiol. Combinations of monols, diols, triols and/or tetrol may be used. The alcohol initiator may include from 1 to 30 carbon atoms. All individual values and subranges from 1 to 30 carbon atoms are included; for example, the alcohol initiator may have from a lower limit of 1, 3, or 5 carbon atoms to an upper limit of 30, 25, or 20 carbon atoms.

The oil soluble polyalkylene glycols may be prepared by a known process with known conditions. The oil soluble polyalkylene glycols may be obtained commercially. Examples of commercial oil soluble polyalkylene glycols include, but are not limited to, oil soluble polyalkylene glycols under the trade name UCON™, such as UCON™ OSP-12 and UCON™ OSP-18 both available from The Dow Chemical Company.

The acid that is reacted with the oil soluble polyalkylene glycol to form the esterified oil soluble polyalkylene glycols disclosed herein can be a carboxylic acid. Examples of such carboxylic acids include, but are not limited to, acetic acid, propanoic acid, pentanoic acid, e.g., n-pentanoic acid, valeric acid, e.g., isovaleric acid, caprylic acid, dodecanoic acid, combinations thereof.

To form the E-OSP disclosed herein, the oil soluble polyalkylene glycol and the acid may be reacted at a molar ratio of 10 moles of oil soluble polyalkylene glycol: 1 mole of acid to 1 mole of oil soluble polyalkylene glycol:10 moles of acid. All individual values and subranges from 10:1 moles of oil soluble polyalkylene glycol to moles of acid to 1:10 moles of oil soluble polyalkylene glycol to moles of acid are included; for example oil soluble polyalkylene glycol and the acid may be reacted at a molar ratio of 10:1, 9:1, 8:1, 7:1, 6:1, 5:1, 4:1, 3:1, 2:1, 1:1, 1:2, 1:3, 1:4, 1:5, 1:6, 1:7, 1:8, 1:9, or 1:10 moles of oil soluble polyalkylene glycol to moles of acid.

The E-OSP may be prepared by a known process with known conditions. For instance, the esterified oil soluble polyalkylene glycols disclosed herein may be formed by an esterification process, e.g., Fisher Esterification. Generally, the reactions for the esterification process can take place at atmospheric pressure (101,325 Pa), at a temperature of 60 to 170° C. for 1 to 10 hours. In addition, known components such as acid catalysts, neutralizers, and/or salt absorbers, among other known components, may be utilized in the esterification reaction. An example of a preferred acid catalyst is p-toluenesulfonic acid (PTSA), among others. Examples of neutralizers are sodium carbonate and potassium hydroxide, among others. An example of a salt absorber is magnesium silicate, among others.

As discussed above, the E-OSP of the present disclosure has the structure of Formula I:

$$R^1[O(R^2O)_n(R^3O)_m(C{=}O)R^4]_p \qquad \text{Formula I}$$

$R^1$ is a linear alkyl having 1 to 18 carbon atoms, a branched alkyl having 4 to 18 carbon atoms or an aryl with 6 to 30 carbon atoms. Preferably, $R^1$ is a linear alkyl with 10 to 14 carbon atoms. $R^1$ corresponds to the residual of an alcohol initiator used during the polymerization of the oil soluble polyalkylene glycol discussed herein. As used herein, "alkyl group" refers to a saturated monovalent hydrocarbon group. As used herein an "aryl group" refers to a mono- or polynuclear aromatic hydrocarbon group; the aryl group may include an alkyl substituent. The aryl group, including the alkyl substituent when present, for $R^1$ can have 6 to 30 carbons.

$R^2O$ is an oxypropylene moiety derived from 1,2-propylene oxide, where the resulting structure of $R^2O$ in Formula I can be either [—$CH_2CH(CH_3)$—O-] or [—$CH(CH_3)CH_2$—O—]. $R^3O$ is an oxybutylene moiety derived from butylene oxide, where the resulting structure of $R^3O$ in Formula I can be either [—$CH_2CH(C_2H_5)$—O-] or [—$CH(C_2H_5)CH_2$—O-] when $R^3O$ is derived from 1,2-butylene oxide. For the various embodiments, $R^2O$ and $R^3O$ are in a block or a random distribution in Formula I.

$R^4$ is a linear alkyl with 1 to 18 carbon atoms, a branched alkyl with 4 to 18 carbon atoms or an aryl with 6 to 18 carbon atoms. Preferably, $R^4$ is a linear alkyl with 1 to 8 carbon atoms. As used herein, "alkyl group" refers to a saturated monovalent hydrocarbon group. As used herein an "aryl group" refers to a mono- or polynuclear aromatic hydrocarbon group; the aryl group may include an alkyl substituent. The aryl group, including the alkyl substituent when present, for $R^4$ can have 6 to 18 carbons.

The values for n and m are each independently integers ranging from 0 to 20, where n+m is greater than 0. Preferably, n and m are each independently integers ranging from 5 to 10. In another preferred embodiment, n and m are each independently integers ranging from 3 to 5. The value for p is an integer from 1 to 4.

The E-OSPs disclosed herein may have a viscosity index determined according to ASTM D2270 from 130 to 200. All individual values and subranges from 130 to 200 are included; for example, the E-OSPs may have a viscosity index from a lower limit of 130 or 135 to an upper limit of 200 or 195. This improved viscosity index, as compared to some other lubricants, such as similar non-esterified oil soluble polyalkylene glycols, is advantageous to previous a previous process for increasing viscosity index, i.e. an alkylation capping process, because esterification can be achieved via a simpler process and/or at a reduced cost.

The lubricant composition is also comprised of a polar viscosity improver. The polar viscosity improver (PVI) is an additive that improves the viscosity index (VI) and is readily soluble in the E-OSP. Generally, herein, the polar viscosity improver is one that is a polyalkylmethacrylate that may incorporate groups that are useful as a dispersant as further described below. Any useful amount of the viscosity improver may be used, but typically the amount is from about 0.1% to 10% by weight of the lubricant composition and preferably about 0.25, 0.5, 1%, 1.5% or 2% to about 5% by weight of the lubricant composition.

The PVI generally has a weight average molecular weight Mw of 10,000 to 100,000. Preferably, the Mw is from 15,000 to 50,000. The weight average molecular weight of the polyalkyl(meth)acrylate (PAMA) may preferably be 17000 to 25000, more preferably 18000 to 24000.

The PAMA may preferably be those having a structural unit represented by the Formula (1).

Formula 1

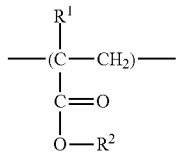

In formula (1), $R^1$ may be a hydrogen atom or a methyl group, preferably a methyl group, and $R^2$ may be a hydrocarbon group having 1 to 30 carbon atoms or a group represented by the formula —$(R)_a$-E, wherein R stands for an alkylene group having 1 to 30 carbon atoms, E stands for an amine or heterocyclic residue having 1 to 2 nitrogen atoms and 0 to 2 oxygen atoms, and a is 0 or 1.

Examples of the alkyl group having 1 to 30 carbon atoms represented by $R^2$ may include methyl, ethyl, propyl, butyl, pentyl, hexyl, heptyl, octyl, nonyl, decyl, undecyl, dodecyl, tridecyl, tetradecyl, pentadecyl, hexadecyl, hepta-decyl, octadecyl, icosyl, docosyl, tetracosyl, hexacosyl, and octacosyl groups. These alkyl groups may be either straight or branched.

Examples of the alkylene group having 1 to 30 carbon atoms represented by $R^2$ may include methylene, ethylene, propylene, butylene, pentylene, hexylene, heptylene, octylene, nonylene, decylene, undecylene, dodecylene, tridecylene, tetradecylene, pentadecylene, hexadecylene, heptadecylene, and octadecylene groups. These alkylene groups may be either straight or branched.

Examples of the amine residue represented by E may include dimethylamino, diethylamino, dipropylamino, dibutylamino, anilino, toluidino, xylidino, acetylamino, and benzoylamino groups. Examples of the heterocyclic residue represented by E may include morpholino, pyrrolyl, pyrrolino, pyridyl, methylpyridyl, pyrrolidinyl, piperidinyl, quinonyl, pyrrolidonyl, pyrrolidono, imidazolino, and pyrazino groups.

Examples of the poly(meth)acrylate having a structural unit represented by the formula (1) may include poly(meth) acrylates prepared by polymerizing or copolymerizing one or more monomers represented by the formula (1a)

$$CH_2{=}CH(R^1)—C({=}O)—OR^2 \qquad \text{Formula 1a:}$$

wherein $R^1$ and $R^2$ are the same as those in the Formula (1).

Examples of the monomers represented by the formula (1a) may include the following monomers (Ba) to (Be).

Monomer (Ba) is a (meth)acrylate having an alkyl group with 1 to 4 carbon atoms, and may specifically be methyl (meth)acrylate, ethyl(meth)acrylate, n- or i-propyl-(meth) acrylate, n-, i-, or sec-butyl (meth)acrylate, with methyl (meth)acrylate being preferred.

Monomer (Bb) is a (meth)acrylate having an alkyl or alkenyl group with 5 to 15 carbon atoms, and may specifically be octyl.(meth)acrylate, nonyl(meth)acrylate, decyl (meth)acrylate, undecyl(meth)acrylate, dodecyl-(meth)acrylate, tridecyl(methacrylate, tetradecyl(meth)acrylate, pentadecyl(meth)acrylate, octenyl meth)acrylate, nonenyl (meth)acrylate, decenyl(meth)acrylate, undecenyl(meth) acrylate, dodecenyl (meth)acrylate, tridecenyl(meth)acrylate, tetradecenyl(meth)acrylate, or penta-decenyl(meth) acrylate. These may be either straight or branched. (Meth) acrylates mainly containing straight alkyl groups with 12 to 15 carbon atoms are preferred.

Monomer (Bc) is a (meth)acrylate having a straight alkyl or alkenyl group with 16 to 30 carbon atoms, preferably a straight alkyl group with 16 to 20 carbon atoms, more preferably a straight alkyl group with 16 or 18 carbon atoms. Specific examples of monomer (Be) may include n-hexadecyl(meth)acrylate, n-octadecyl(meth)acrylate, n-icosyl (meth)acrylate, n-docosyl(meth)acrylate, n-tetracosyl(meth) acrylate, n-hexacosyl meth)acrylate, and n-octacosyl(meth) acrylate, with n-hexadecyl (meth)acrylate and n-octadecyl (meth)acrylate being preferred.

Monomer (Bd) is a (meth)acrylate having a branched alkyl or alkenyl group with 16 to 30 carbon atoms, preferably a branched alkyl group with 20 to 28 carbon atoms, more preferably a branched alkyl group with 22 to 26 carbon atoms. Specific examples of monomer (Bd) may include branched hexadecyl(meth)acrylate, branched octadecyl (meth)acrylate, branched icosyl (meth)acrylate, branched docosyl(meth)acrylate, branched tetracosyl-(methacrylate, branched hexacosyl(meth)acrylate, and branched octacosyl (meth)acrylate, (Meth)acrylates represented by the formula —C—C($R^3$)$R^4$, having a branched alkyl group with 16 to 30, preferably 20 to 28, more preferably 22 to 26 carbon atoms are preferred. In the formula, $R^3$ and $R^4$ are not particularly limited as long as the carbon number of C—C—($R^3$)$R^4$ is 16 to 30, and $R^3$ may preferably be a straight alkyl group having 6 to 12, more preferably 10 to 12 carbon atoms, and $R^4$ may preferably be a straight alkyl group having 10 to 16, more preferably 14 to 16 carbon atoms.

Specific examples of monomer (Bd) may include (meth) acrylates having a branched alkyl group with 20 to 30 carbon atoms, such as 2-decyl-tetradecyl(meth)acrylate, 2-dodecyl-hexadecyl(meth)acrylate, and 2-decyl-tetradecyloxyethyl (meth)acrylate.

Monomer (Be) is a monomer having a polar group. Examples of monomer (Be) may include vinyl monomers having an amido group, monomers having a nitro group, vinyl monomers having a primary to tertiary amino group, or vinyl monomers having a nitrogen-containing heterocyclic group; chlorides, nitrides/or phosphates thereof; lower alkyl monocarboxylates, such as those having 1 to 8 carbon atoms, vinyl monomers having a quaternary ammonium salt group, amphoteric vinyl monomers containing oxygen and nitrogen, monomers having a nitrile group, vinyl aliphatic hydrocarbon monomers, vinyl alicyclic hydrocarbon monomers, vinyl aromatic hydrocarbon monomers, vinyl esters, vinyl ethers, vinyl ketones, vinyl monomers having an epoxy group, vinyl monomers having a halogen, unsaturated carboxylates, vinyl monomers having a hydroxyl group, vinyl monomers having a polyoxyalkylene chain, vinyl monomers having an ionic group, such as anionic, phosphate, sulfonate, or sulfate group; monovalent metal salts, divalent metal salts, amine salts, or ammonium salts thereof.

As monomer (Be), monomers containing nitrogen are preferred among these, which may be, for example, 4-diphenylamine (meth)acrylamide, 2-diphenylamine (meth) acrylamide, dimethylaminoethyl (meth)acrylamide, diethylaminoethyl (meth)acrylamide, dimethylaminopropyl (meth) acrylamide, dimethylaminomethyl methacrylate, diethylaminomethyl methacrylate, dimethylaminoethyl (meth)acrylate, diethylaminoethyl (meth)acrylate, morpholinomethyl methacrylate, morpholinoethyl methacrylate, 2-vinyl-5-methylpyridine, or N-vinylpyrrolidone.

The PVI may be any containing a PAMA obtained by polymerizing or copolymerizing one or more monomers selected from the above monomers (Ba) to (Be).

More preferred examples of such poly(meth)acrylate compound may include:

(1) non-dispersant type PAMA which is a copolymer of monomers (Ba) and (Bb), which may be hydrogenated to remove any remaining double bonds;

(2) non-dispersant type PAMA which is a copolymer of monomers (Ba), (Bb), and (Bc), which may be hydrogenated to remove any remaining double bonds;

(3) non-dispersant type PAMA which is a copolymer of monomers (Ba), (Bb), (Bc), and (Bd) which may be hydrogenated to remove any remaining double bonds;

(4) dispersant type PAMA which is a copolymer of monomers (Ba), (Bb), and (Be), which may be hydrogenated to remove any remaining double bonds;

(5) dispersant type PAMA which is a copolymer of monomers (Ba), (Bb), (Bc), and (Be), or which may be hydrogenated to remove any remaining double bonds; and (6) dispersant type PAMA which is a copolymer of monomers (Ba), (Bb), (Bc), (Bd), and (Be), which may be hydrogenated to remove any remaining double bonds.

Among these, non-dispersant type PAMA compounds (1) to (3) above are more preferred, and non-dispersant type poly(meth)acrylate compounds (2) and (3) are still more preferred, and non-dispersant type poly (meth)acrylate compound (3) is particularly preferred. In another embodiment, the PVI may be a copolymer of the aforementioned monomers and one or more alphaolefins. Illustrative examples of such PVIs include those available under the tradenames VISCOPLEX and VISCOBASE from Evonik Industries.

The PVI may be diluted or solubilized in a diluent. In an embodiment the PVI may first be solubilized in the E-OSP prior to mixing with the hydrocarbon base oil. It may be solubilized in other solvents as well or in the E-OSP at high concentrations which are then mixed with the hydrocarbon base oil and if desired with further E-OSP.

To make the lubricant composition, the PVI typically is dissolved into the E-OSP. The dissolution may be carried out any useful temperature such as ambient temperature, but may be facilitated by heating to accelerate the dissolution. The heating generally is to a temperature less than where any significant volatility or decomposition occurs of either the PVI or E-OSP such as from about 30° C., 40° C., or 50° C. to about 200° C., 150° C. or 100° C. The dissolution may be accomplished using any known method or apparatus of mixing two components together.

In an embodiment, it has been discovered that the E-OSP allows for the polar viscosity improver present in the lubricant composition to be greater than an amount that would be soluble in the base hydrocarbon oil in the absence of the E-OSP. Generally, the PVI is soluble in the esterified polyalkylene glycol in an amount of at least 0.5% by weight. Desirably, the PVI is soluble in an amount of at least 1% to 10%, 25%, 50% by weight or completely miscible.

The lubricant composition of E-OSP and PVI may be added to a base hydrocarbon oil to make the lubricant composition where the E-OSPs are oil soluble (are miscible) in the base oil. The lubricant formulation of the present disclosure can include greater than 50 to 99.9 weight percent (wt. %) of the base oil and 0.01 wt. % up to 50% by weight of the E-OSP and PVI composition, where the wt. % is based on the total weight of the hydrocarbon lubricant composition. In a preferred embodiment, the hydrocarbon lubricant formulation comprises 70% to 99% by weight of the hydrocarbon base oil and 1% to 30% by weight of the E-OSP and PVI. The PVI is present in the E-OSP at amounts that generally range from 0.1% to 50% by weight, but typically present in an amount less than 20% by weight of the PVI and E-OSP. This amount of PVI generally results in the polar viscosity improver being present in an amount by weight of 0.01% to 10% of the lubricant composition. In another embodiment the E-OSP is present in the lubricant composition in an amount of 5% to 30% by weight of the lubricant composition.

The hydrocarbon base oil for the lubricant formulation is desirably selected from the group consisting of an American Petroleum Institute (API) Group I hydrocarbon base oil, an API Group II hydrocarbon base oil, an API Group III hydrocarbon base oil, an API Group IV hydrocarbon base oil and a combination thereof. Preferably, the base oil of the hydrocarbon lubricant composition is an API Group III hydrocarbon base oil. The composition of API Group I-IV hydrocarbon oils are as follows. Group II and Group III hydrocarbon oils are typically prepared from conventional Group I feed stocks using a severe hydrogenation step to reduce the aromatic, sulfur and nitrogen content, followed by de-waxing, hydro-finishing, extraction and/or distillation steps to produce the finished base oil. Group II and III base stocks differ from conventional solvent refined Group I base stocks in that their sulfur, nitrogen and aromatic contents are very low. As a result, these base oils are compositionally very different from conventional solvent refined base stocks. The API has categorized these different base stock types as follows: Group I, >0.03 wt. % sulfur, and/or <90 vol % saturates, viscosity index between 80 and 120; Group II, ≤0.03 wt. % sulfur, and ≥90 vol % saturates, viscosity index between 80 and 120; Group III, ≤0.03 wt. % sulfur, and ≥90 vol % saturates, viscosity index>120. Group IV are polyalphaolefins (PAO). Hydrotreated base stocks and catalytically dewaxed base stocks, because of their low sulfur and aromatics content, generally fall into the Group II and Group III categories.

The E-OSP and PVI combination when added to a hydrocarbon oil may not only help to improve the VI, but also improve other properties such as decrease the kinematic viscosity at −20° C. (solubilize) and allow for higher concentrations of the PVI within the hydrocarbon lubricant composition in the absence of the E-OSP. Likewise the E-OSP and PVI composition may improve the viscosity index of the base oil having a kinematic viscosity of at least 8 cSt at 40° C. as measured according to ASTM D7042, while simultaneously decreasing the lubricant low temperature (0° C. or −20° C.) viscosity by blending the E-OSP and PVI composition into the hydrocarbon base oil. In other words, the inclusion of an E-OSP and PVI composition into a hydrocarbon base oil may lead to a desirable improvement in the viscosity index and a favorable decrease in low temperature viscosity compared to the hydrocarbon base oil alone or the hydrocarbon base oil combined with either the E-OSP or PVI alone.

The present disclosure also provides for a method of forming the hydrocarbon lubricant composition for use, for example, in an internal combustion engine. The method includes providing the hydrocarbon base oil, as described herein, and admixing with the hydrocarbon base oil with the already formed E-OSP and PVI composition, which is to say the PVI is first dissolved into the E-OSP and then admixed into the hydrocarbon base oil, to form the hydrocarbon lubricant composition that may be particularly useful for an internal combustion engine.

The lubricant composition may also advantageously contain one or more additives such as ferrous corrosion inhibitors, yellow metal passivators, antioxidants, pour point depressants, anti-wear additives, extreme pressure additives, antifoams, demulsifiers, dispersants and detergents, dyes and the like.

The lubricant composition desirably and surprisingly may realize a lubricant composition that has improved viscosity index and low kinematic viscosity at cold temperatures (e.g., −20° C.) while still maintaining sufficient viscosity at high temperatures (e.g. 100° C.). Exemplary desirable lubricant compositions having the following kinematic viscosity (KV) and viscosity index (VI) are obtainable by the lubricant compositions of the invention. The lubricant compositions may have $KV_{100}$ (KV at 100° C.) that range from 2 to 5 centistokes and $KV_{20}$ (KV at −20° C.) that is at most 1000 centistokes, 600 centistokes, 500 centistokes, 400 centistoke or even 350 centistokes all the while achieving a VI of at least about 150, 160, 170 or even 180 (about 150 is inclusive for example of VIs that are within 1 or 2 VI units distant therefrom).

EXAMPLES

Synthesis of E-OSP

UCON OSP-12 (374 g, 1 mol) and n-pentanoic acid (102 g, 1 mol) in toluene (500 mL) was stirred at room temperature. PTSA (1.90 g, 0.001 mol) was added with stirring and the mixture was refluxed with Dean-Stark to remove 18.0 mL water from the system at 135° C. for overnight. After the mixture cooled to room temperature, KOH (1.12 g, 0.002 mol) was added and stirred overnight to neutralize PTSA. 10 g magnesium silicate was added and stirred at 60° C. for 3 hours to absorb the generated salt in the system, then the mixture was filtered through a filter paper. After filtration, the residue solvent was removed by vacuum distillation and a light yellow liquid was obtained.

The synthesis of OSP18-C5 used the same synthesis procedure as OSP12-C5 but starting from UCON OSP-18 and using the same molar ratios of reactants.

Composition Preparation

Formulations were prepared by adding each component of the formulation as identified in Tables 2-4 into a 20 mL glass container to from a 10 mL sample. Keep the sample at 150° C. for 1 hr in oven. The sample was removed from the oven and stirred using a Thermo Scientific vortex oscillator for 10 min at 3000 RPM. The procedure was repeated until each of the resulting formulations were clear and homogenous unless otherwise noted in the Tables.

Test Method

ASTM (American Society for Testing and Materials) test methods are used as below:

Kinematic viscosity is measured according to ASTM D7042.

$KV_{-20}$ is kinematic viscosity at −20° C. in cSt ($mm^2$/sec)

$KV_{-10}$ is kinematic viscosity at −10° C. in cSt.

$KV_0$ is kinematic viscosity at 0° C. in cSt.

$KV_{40}$ is kinematic viscosity at 40° C. in cSt.

$KV_{100}$ is kinematic viscosity at 100° C. in cSt.

Viscosity index is calculated according to ASTM D2270.

Materials

TABLE 1

Materials List for Examples and Comparative Examples

| Ingredient | Acronym | Description | Source |
|---|---|---|---|
| | | OSP BASE OILS | |
| UCON ™ OSP-12 | OSP-12 | Dodecanol (C12) initiated PO/BO (50/50 w/w), random copolymer with a typical kinematic viscosity at 40° C. ($KV_{40}$) of 12 cSt ($mm^2$/sec) a typical kinematic viscosity at 100° C. ($KV_{100}$) of 3 cSt and viscosity index of 103. | The Dow Chemical Company (TDCC) |
| UCON ™ OSP-18 | OSP-18 | Dodecanol initiated PO/BO (50/50 w/w), random copolymer with a typical kinematic viscosity at 40° C. of 18 cSt and a typical kinematic viscosity at 100° C. ($KV_{100}$) of 4 cSt and viscosity index of 121. | TDCC |
| | | EXPERIMENTAL ESTERIFIED OSPs | |
| OSP18-C5 | OSP18-C5 | Esterified OSP18 by reaction with valeric acid (C5). Experimental sample with $KV_{40}$ of 15.3 cSt, $KV_{100}$ of 4.0 cSt, pour point of −55° C. and VI of 160. | Synthesized |
| OSP12-C5 | OSP12-C5 | Esterified OSP12 by reaction with valeric acid (C5). Experimental sample with $KV_{40}$ of 10.3 cSt, $KV_{100}$ of 3.06 cSt, pour point of −43° C. and VI of 171. | Synthesized |
| | | HYDROCARBON BASE OILS | |
| YUBASE 3 | Y3 | An API Group III base oil with a typical kinematic viscosity at 40° C. of 3.1 mm2/sec and kinematic viscosity at 40° C. of 12.4 $mm^2$/sec, VI of 122 and Noack volatility of about 15% using DIN 51581. | SK Oil |
| YUBASE 4 | Y4 | An API Group III base oil with a typical kinematic viscosity at 100° C. of 4.3 cSt and kinematic viscosity at 40° C. of 19.6 $mm^2$/sec, VI of 122 and Noack volatility of 40% using DIN 51581. | SK Oil |
| | | VISCOSITY IMPROVERS | |
| LUBRIZOL 7065 | LZ-7065 | Shear Stable Olefin Copolymer (OCP). Ethylene-propylene-monomer (EPM) type VI improver with a typical ethylene content of 47 wt %, Mooney viscosity ML(1 + 4)100° C. of 30, and is a solid at room temperature. | Lubrizol |
| INFINEUM J-0010 | J-0010 | Shear Stable Olefin Copolymer (OCP). Ethylene propylene monomer (EPM) type VI Improver with a typical ethylene content of 52 wt %, Mooney viscosity ML(1 + 4)100° C. of 10. It is a solid at room temperature. | Jilin Petrochemical |
| VISCOPLEX 6-054 | 6-054 | Shear stable polyalkylmethacrylate (PAMA). Its compositions contains a 1:1 w/w mixture of PAMA and mineral oil. Its typical properties are kinematic viscosity at 100° C. ($KV_{100}$) is 500 cSt (ASTM D445), shear stability index (PSSI) is 5 (ASTM D6278), density at 15° C. is 0.91 g/ml and flash point is 120° C. (ASTM D3278). | Evonik |
| VISCOPLEX 12-075 | 12-075 | Shear stable polyalkylmethacrylate (PAMA). Its compositions contains a 80:20 w/w mixture of PAMA and mineral oil. Its typical properties are kinematic viscosity at 100° C. ($KV_{100}$) is 575 cSt (ASTM D445), density at 15° C. is 0.96 g/ml and flash point is 94° C. (ASTM D3278). | Evonik |
| SV 260 | SV 260 | A hydrogenated styrene-diene polymer (HSD) type VI improver, typically contains high MW content with Mn 70 × $10^4$ g/mol, PDI 1.09, and low MW content with Mn 6.59 × $10^4$ g/mol, PDI 1.14. It is a solid at room temperature with a snowflake appearance. | Infineum |

The following compounds are available from Sinopharm Chemical Reagent Co. Ltd: PTSA, $Na_2CO_3$ (neutralizer), KOH (neutralizer), magnesium silicate (salt absorber), The following compounds are available from Energy Chemical; n-pentanoic acid (acid).

From the following Tables of the compositions and viscosity index results and kinematic viscosity at −20° C., it is readily apparent that the E-OSP in combination surprisingly may result in a hydrocarbon based lubricant that has Viscosity Indices (VI) that are improved greater even exceeding 150 substantially while still realizing a desired high temperature viscosity ($KV_{100}$) such as between 3 and 5 cSt and a low temperature viscosity ($KV_{-20}$) that is within 10% of the hydrocarbon oil (Tables 5, 7, 10, 11 and 13). In contrast, when a non-polar viscosity improver is used, the VI does increase substantially, but in every case, the $KV_{-20}$ is substantially increased from more than twice that of the hydrocarbon based oil alone or even an order of magnitude higher. (see Tables 5, 6, 8, 9, 11 and 12). Likewise, the high temperature $KV_{100}$ for non-polar VI improvers is substantially raised too.

TABLE 3

Compositions Based on Yubase 4
Comp. Ex. Based on Yubase 4 and Innovation Ex. with 10% E-OSP

| Sample Name | Comp. Ex. V18 | Comp. Ex. V19 | Comp. Ex. V20 | Comp. Ex. V21 | Comp. Ex. V22 |
|---|---|---|---|---|---|
| Yubase 4, % | 100 | 90 | 89 | 88 | 85 |
| OSP18/C5, % | | 10 | 10 | 10 | 10 |
| LZ-7065 | | | 1 | 2 | 5 |

| Sample Name | Example V23 | Example V24 | Example V25 |
|---|---|---|---|
| Yubase 4, % | 89 | 88 | 85 |
| OSP18/C5, % | 10 | 10 | 10 |
| 6-054, % | 1 | 2 | 5 |

TABLE 2

Compositions Based on Yubase 3
Comp. Ex. Based on Yubase 3 and Innovation Ex. with 10% E-OSP

| Sample Name | Comp. Ex. V1 | Comp. Ex. V2 | Comp. Ex. V3 | Comp. Ex. V4 | V5 | Comp. Ex. V3-2 (V26) | Comp. Ex. V4-2 (V27) | Comp. Ex. V5-2 (V28) |
|---|---|---|---|---|---|---|---|---|
| Yubase 3, % | 100 | 90 | 89 | 88 | 85 | 99 | 98 | 95 |
| OSP12/C5, % | | 10 | 10 | 10 | 10 | | | |
| LZ-7065, % | | | 1 | 2 | 5 | 1 | 2 | 5 |

| Sample Name | Comp. Ex. V6 | Comp. Ex. V7 | Comp. Ex. V8 | Comp. Ex. V6-2 | Comp. Ex. V7-2 | Comp. Ex. V8-2 |
|---|---|---|---|---|---|---|
| Yubase 3, % | 89 | 88 | 85 | 99 | 98 | 95 |
| OSP12/C5, % | 10 | 10 | 10 | | | |
| SV260, % | 1 | 2 | 5 | 1 | 2 | 5 |

| Sample Name | Comp. Ex. V9 | Comp. Ex. V10 | V11 | Comp. Ex. V9-2 | Comp. Ex. V10-2 | Comp. Ex. V11-2 |
|---|---|---|---|---|---|---|
| Yubase 3, % | 89 | 88 | 85 | 99 | 98 | 95 |
| OSP12/C5, % | 10 | 10 | 10 | | | |
| J-0010, % | 1 | 2 | 5 | 1 | 2 | 5 |

| Sample Name | Example V12 | Example V13 | Example V14 | Comp. Ex. V12-2 (V38) | Comp. Ex. V13-2 (V39) | Comp. Ex. V14-2 (V40) |
|---|---|---|---|---|---|---|
| Yubase 3, % | 89 | 88 | 85 | 99 | 98 | 95 |
| OSP12/C5, % | 10 | 10 | 10 | | | |
| 6-054, % | 1 | 2 | 5 | 1 | 2 | 5 |

| Sample Name | Example V15 | Example V16 | Example V17 | Comp. Ex. V15-2 | Comp. Ex. V16-2 | Comp. Ex. V17-2 |
|---|---|---|---|---|---|---|
| Yubase 3, % | 89 | 88 | 85 | 99 | 98 | 95 |
| OSP12/C5, % | 10 | 10 | 10 | | | |
| 12-075, % | 1 | 2 | 5 | 1 | 2 | 5 |

TABLE 4

Compositions Based on Yubase 3 and 4
Comp. Ex. and Innovation Ex. with 5% and 20% E-OSP

| Sample Name | Comp. Ex. V26 (V3-2) | Comp. Ex. V27 (V4-2) | Comp. Ex. V28 (V5-2) | Comp. Ex. V30 | Comp. Ex. V31 | Comp. Ex. V32 | Comp. Ex. V33 |
|---|---|---|---|---|---|---|---|
| Yubase 3, % | 99 | 98 | 95 | 95 | 94 | 93 | 90 |
| OSP12/C5, % | | | | 5 | 5 | 5 | 5 |
| LZ-7065, % | 1 | 2 | 5 | | 1 | 2 | 5 |

| Sample Name | Comp. Ex. V34 | Comp. Ex. V35 | Comp. Ex. V36 | Comp. Ex. V37 |
|---|---|---|---|---|
| Yubase 3, % | 80 | 79 | 78 | 75 |
| OSP12/C5, % | 20 | 20 | 20 | 20 |
| LZ-7065, % | | 1 | 2 | 5 |

| Sample Name | Comp. Ex. V38 (V12-2) | Comp. Ex. V39 (V13-2) | Comp. Ex. V40 (V14-2) | Comp. Ex. V42 | Example V43 | Example V44 | Example V45 |
|---|---|---|---|---|---|---|---|
| Yubase 3, % | 99 | 98 | 95 | 95 | 94 | 93 | 90 |
| OSP12/C5, % | | | | 5 | 5 | 5 | 5 |
| 6-054, % | 1 | 2 | 5 | | 1 | 2 | 5 |

| Sample Name | Comp. Ex. V46 | Example V47 | Example V48 | Example V49 |
|---|---|---|---|---|
| Yubase 3, % | 80 | 79 | 78 | 75 |
| OSP12/C5, % | 20 | 20 | 20 | 20 |
| 6-054, % | | 1 | 2 | 5 |

| Sample Name | Comp. Ex. VX26 | Comp. Ex. VX27 | Comp. Ex. VX28 | Comp. Ex. VX30 | Comp. Ex. VX31 |
|---|---|---|---|---|---|
| Yubase 4, % | 99 | 98 | 95 | 95 | 94 |
| OSP18/C5, % | | | | 5 | 5 |
| LZ-7065, % | 1 | 2 | 5 | | 1 |

| Sample Name | Comp. Ex. VX34 | Comp. Ex. VX35 |
|---|---|---|
| Yubase 4, % | 80 | 79 |
| OSP18/C5, % | 20 | 20 |
| LZ-7065, % | | 1 |

| Sample Name | Comp. Ex. VX38 | Comp. Ex. VX39 | Comp. Ex. VX40 | Comp. Ex. VX42 | Example VX43 |
|---|---|---|---|---|---|
| Yubase 4, % | 99 | 98 | 95 | 95 | 94 |
| OSP18/C5, % | | | | 5 | 5 |
| 6-054, % | 1 | 2 | 5 | | 1 |

| Sample Name | Comp. Ex. VX46 | Example VX47 |
|---|---|---|
| Yubase 4, % | 80 | 79 |
| OSP18/C5, % | 20 | 20 |
| 6-054, % | | 1 |

TABLE 5

| Comp. Ex. Based on Yubase 3 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V1 | 304 | 144 | 75.1 | 12.4 | 3.09 | 108 | Y3 | |
| Comp. Ex. V30 | 281 | 135 | 71.5 | 12.1 | 3.05 | 108 | Y3 + 5% E3 | |
| Comp. Ex. V2 | 266 | 128 | 68.1 | 11.8 | 3.01 | 109 | Y3 + 10% E3 | |
| Comp. Ex. V34 | 238 | 116 | 63.1 | 11.4 | 2.98 | 116 | Y3 + 20% E3 | |

TABLE 6

| Yubase 3, OSP12-C5 and LZ-7065 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V26 | 843 | 385 | 194 | 28.4 | 6.25 | 179 | Y3 + 1% LZ-7065 | |
| Comp. Ex. V31 | 758 | 349 | 178 | 26.7 | 5.86 | 172 | Y3 + 5% E3 + 1% LZ-7065 | |
| Comp. Ex. V3 | 700 | 328 | 169 | 26.5 | 6.10 | 190 | Y3 + 10% E3 + 1% LZ-7065 | |
| Comp. Ex. V35 | 593 | 282 | 147 | 23.5 | 5.54 | 188 | Y3 + 20% E3 + 1% LZ-7065 | |
| Comp. Ex. V27 | 1812 | 792 | 387 | 51.9 | 10.5 | 197 | Y3 + 2% LZ-7065 | |
| Comp. Ex. V32 | 1592 | 711 | 352 | 48.8 | 10.0 | 199 | Y3 + 5% E3 + 2% LZ-7065 | |
| Comp. Ex. V4 | 1396 | 626 | 315 | 45.9 | 9.7 | 203 | Y3 + 10% E3 + 2% LZ-7065 | |
| Comp. Ex. V36 | 1317 | 604 | 306 | 45.1 | 9.88 | 213 | Y3 + 20% E3 + 2% LZ-7065 | |
| Comp. Ex. V5-2 | | | | | | | Y3 + 5% LZ-7065 | Insoluble |
| Comp. Ex. V33 | | | | | | | Y3 + 5% E3 + 5% LZ-7065 | Insoluble |
| Comp. Ex. V5 | | | | | | | Y3 + 10% E3 + 5% LZ-7065 | Insoluble |
| Comp. Ex. V37 | | | | | | | Y3 + 20% E3 + 5% LZ-7065 | Insoluble |

TABLE 7

| Yubase 3, OSP12-C5 and 6-054 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V38 | 326 | 156 | 82.1 | 13.7 | 3.38 | 122 | Y3 + 1% 6-054 | |
| Ex. V43 | 300 | 145 | 77.4 | 13.2 | 3.30 | 121 | Y3 + 5% E3 + 1% 6-054 | |
| Ex. V12 | 294 | 141 | 75.4 | 12.9 | 3.29 | 127 | Y3 + 10% E3 + 1% 6-054 | |
| Ex. V47 | 256 | 126 | 68.4 | 12.4 | 3.23 | 131 | Y3 + 20% E3 + 1% 6-054 | |
| Comp. Ex. V39 | 338 | 163 | 86.4 | 14.5 | 3.58 | 131 | Y3 + 2% 6-054 | |
| Ex. V44 | 324 | 157 | 83.8 | 14.3 | 3.60 | 138 | Y3 + 5% E3 + 2% 6-054 | |
| Ex. V13 | 321 | 156 | 83.9 | 14.6 | 3.71 | 146 | Y3 + 10% E3 + 2% 6-054 | |
| Ex. V48 | 279 | 138 | 75.0 | 13.5 | 3.53 | 146 | Y3 + 20% E3 + 2% 6-054 | |
| Comp. Ex. V40 | 437 | 209 | 110 | 18.6 | 4.59 | 172 | Y3 + 5% 6-054 | |
| Ex. V45 | 393 | 192 | 102 | 17.7 | 4.42 | 171 | Y3 + 5% E3 + 5% 6-054 | |
| Ex. V14 | 390 | 190 | 102 | 17.9 | 4.48 | 174 | Y3 + 10% E3 + 5% 6-054 | |
| Ex. V49 | 349 | 174 | 95.1 | 17.3 | 4.45 | 182 | Y3 + 20% E3 + 5% 6-054 | |

TABLE 8

| Yubase 3, OSP12-C5 and SV260 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V6-2 | 963 | 431 | 217 | 32.6 | 7.12 | 190 | Y3 + 1% SV260 | |
| Comp. Ex. V6 | 904 | 425 | 220 | 34.4 | 7.77 | 206 | Y3 + 10% E3 + 1% SV260 | |
| Comp. Ex. V7-2 | 2509 | 1106 | 542 | 74.0 | 14.9 | 214 | Y3 + 2% SV260 | |
| Comp. Ex. V7 | 1710 | 900 | 480 | 71.0 | 14.9 | 222 | Y3 + 10% E3 + 2% SV260 | |
| Comp. Ex. V8-2 | 33965 | 12240 | 5746 | 577 | 90.6 | 247 | Y3 + 5% SV260 | |
| Comp. Ex. V8 | 27077 | 10901 | 5018 | 554 | 89.0 | 250 | Y3 + 10% E3 + 5% SV260 | |

TABLE 9

| Yubase 3, OSP12-C5 and J-0010 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V9-2 | 711 | 326 | 166 | 25.1 | 5.63 | 174 | Y3 + 1% J-0010 | |
| Comp. Ex. V9 | 630 | 293 | 151 | 23.9 | 5.61 | 187 | Y3 + 10% E3 + 1% J-0010 | |
| Comp. Ex. V10-2 | 1108 | 502 | 251 | 36.2 | 7.68 | 189 | Y3 + 2% J-0010 | |
| Comp. Ex. V10 | 1062 | 488 | 249 | 35.9 | 7.66 | 190 | Y3 + 10% E3 + 2% J-0010 | |
| Comp. Ex. V11-2 | 9804 | 4118 | 1898 | 211 | 34.3 | 210 | Y3 + 5% J-0010 | |
| Comp. Ex. V11 | 8679 | 3701 | 1742 | 202 | 33.8 | 214 | Y3 + 10% E3 + 5% J-0010 | |

TABLE 10

| Yubase 3, OSP12-C5 and 12-075 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V15-2 | 317 | 149 | 78.1 | 13.2 | 3.30 | 121 | Y3 + 1% 12-075 | |
| Ex. V15 | 273 | 132 | 70.6 | 12.3 | 3.15 | 119 | Y3 + 10% E3 + 1% 12-075 | |
| Comp. Ex. V16-2 | 325 | 152 | 79.4 | 13.3 | 3.34 | 123 | Y3 + 2% 12-075 | |
| Ex. V16 | 279 | 135 | 72.6 | 12.7 | 3.26 | 126 | Y3 + 10% E3 + 2% 12-075 | |
| Comp. Ex. V17-2 | 350 | 167 | 88.1 | 14.8 | 3.70 | 141 | Y3 + 5% 12-075 | |
| Ex. V17 | 311 | 152 | 81.5 | 14.4 | 3.69 | 150 | Y3 + 10% E3 + 5% 12-075 | |

"Exceed" means the viscosity value exceeded the equipment upper detection limit.

"Insoluble" means the viscosity improver was not fully solubilized in the formulation.

TABLE 11

| Yubase 4 and OSP18-C5 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. V18 | 1522 | 291 | 134 | 19.5 | 4.26 | 125 | Y4 | |
| Comp. Ex. VX30 | 1448 | 341 | 142 | 19.0 | 4.28 | 134 | Y4 + 5% E4 | |
| Comp. Ex. V19 | 1172 | 248 | 122 | 18.5 | 4.17 | 131 | Y4 + 10% E4 | |
| Comp. Ex. VX34 | 995 | 226 | 113 | 17.8 | 4.13 | 137 | Y4 + 20% E4 | |

TABLE 12

| Yubase 4, OSP18-C5 and LZ-7065 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. VX26 | 53958 | 735 | 343 | 44.3 | 8.58 | 175 | Y4 + 1% LZ-7065 | |
| Comp. Ex. VX31 | 49628 | 735 | 299 | 39.9 | 7.94 | 176 | Y4 + 5% E4 + 1% LZ-7065 | |
| Comp. Ex. V20 | 5305 | 652 | 305 | 41.2 | 8.27 | 181 | Y4 + 10% E4 + 1% LZ-7065 | |
| Comp. Ex. VX35 | 3400 | 578 | 281 | 39.2 | 8.05 | 184 | Y4 + 20% E4 + 1% LZ-7065 | |
| Comp. Ex. VX27 | exceed | 1764 | 605 | 71.7 | 12.9 | 183 | Y4 + 2% LZ-7065 | |
| Comp. Ex. V21 | exceed | 1450 | 628 | 77.0 | 14.1 | 191 | Y4 + 10% E4 + 2% LZ-7065 | |
| Comp. Ex. VX28 | | | | | | | Y4 + 5% LZ-7065 | Insoluble |
| Comp. Ex. V22 | | | | | | | Y4 + 10% E4 + 5% LZ-7065 | Insoluble |

TABLE 13

| Yubase 4, OSP18-C5 and 6-054 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Comp. Ex. VX38 | 703 | 281 | 143 | 21.0 | 4.61 | 139 | Y4 + 1% 6-054 | |
| Ex. VX43 | 635 | 275 | 136 | 20.6 | 4.58 | 142 | Y4 + 5% E4 + 1% 6-054 | |
| Ex. V23 | 596 | 253 | 130 | 20.0 | 4.49 | 142 | Y4 + 10% E4 + 1% 6-054 | |

TABLE 13-continued

| Yubase 4, OSP18-C5 and 6-054 | | | | | | | | |
|---|---|---|---|---|---|---|---|---|
| Sample | KV−20, cSt | KV−10, cSt | KV0, cSt | KV40, cSt | KV100, cSt | VI | Formulation | Note |
| Ex. VX47 | 547 | 244 | 124 | 19.5 | 4.49 | 149 | Y4 + 20% E4 + 1% 6-054 | |
| Comp. Ex. VX39 | 694 | 306 | 153 | 22.6 | 4.93 | 148 | Y4 + 2% 6-054 | |
| Ex. V24 | 612 | 274 | 138 | 21.2 | 4.75 | 150 | Y4 + 10% E4 + 2% 6-054 | |
| Comp. Ex. VX40 | 800 | 369 | 186 | 27.8 | 6.08 | 175 | Y4 + 5% 6-054 | |
| Ex. V25 | 727 | 330 | 171 | 26.2 | 5.88 | 179 | Y4 + 10% E4 + 5% 6-054 | |

We claim:

1. A lubricant composition, comprising:

a hydrocarbon base oil;

a polar viscosity improver; and an esterified polyalkylene glycol:

$$R^1[O(R^2O)_n(R^3O)_m(C{=}O)R^4]_p$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4.

2. The lubricant composition of claim 1, wherein $R^3O$ is derived from 1,2-butylene oxide.

3. The lubricant composition of claim 1, wherein $R^4$ is a linear alkyl with 2 to 8 carbon atoms.

4. The lubricant formulation of claim 1, wherein $R^1$ is a linear alkyl with 8 to 14 carbon atoms.

5. The lubricant composition of claim 1, wherein the polar viscosity improver is a dispersant polyalkylmethacrylate or nondispersant polyalkylmethacrylate.

6. The lubricant composition of claim 5, wherein the polar viscosity improver is the nondispersant polyalkylmethacrylate.

7. The lubricant composition of claim 5, wherein the viscosity improver is comprised of a dispersant polyalkylmethacrylate having one or more amine groups.

8. The lubricant composition of claim 1, wherein the lubricant composition has a viscosity index of at least 100, a kinematic viscosity at 100° C. from 2 to 5 centistokes and a kinematic viscosity at −20° C. of at most 600 centistokes.

9. The lubricant composition claim 8, wherein the kinematic viscosity at −20° C. is at most 500 centistokes.

10. The lubricant composition of claim 9, wherein kinematic viscosity at −20° C. is at most 350 centistokes.

11. The lubricant composition of claim 1, wherein the lubricant composition is comprised of one or more further additives.

12. The lubricant composition of claim 1, wherein the amount viscosity improver is from 0.1% to 10% by weight of the lubricant composition.

13. The lubricant of claim 1, wherein the polar viscosity improver has a weight average molecular weight is from 15,000 to 50,000.

14. The lubricant composition of claim 1, wherein the hydrocarbon base oil is an API Group III or API Group IV hydrocarbon base oil.

15. The lubricant composition of claim 1 wherein the esterified polyalkylene glycol is present in an amount of 5% to 30% by weight of the lubricant composition.

16. The hydrocarbon lubricant composition of claim 1, wherein the hydrocarbon base oil is present in an amount of at least 50% by weight of the lubricant composition.

17. The composition of claim 1 wherein n and m in the esterified polyalkylene glycol are independently an integer from 3 to 5.

18. A method of forming a hydrocarbon lubricant composition comprising:

(i) dissolving, first, a polar viscosity improver into an esterified polyalkylene glycol represented by the following structure:

$$R^1[O(R^2O)_n(R^3O)_m(C{=}O)R^4]_p \qquad \text{Formula I}$$

wherein $R^1$ is a linear alkyl having 1 to 18 carbon atoms, a branched alkyl having 4 to 18 carbon atoms or an aryl with 6 to 30 carbon atoms; $R^2O$ is an oxypropylene moiety derived from 1,2-propylene oxide; $R^3O$ is an oxybutylene moiety derived from butylene oxide, wherein $R^2O$ and $R^3O$ are in a block or a random distribution; $R^4$ is a linear alkyl with 1 to 18 carbon atoms, a branched alkyl with 4 to 18 carbon atoms or an aryl with 6 to 18 carbon atoms; n and m are each independently integers ranging from 0 to 20 wherein n+m is greater than 0, and p is an integer from 1 to 4, to form a solution of the polar viscosity improver and esterified polyalkylene glycol, and then (ii) admixing a base hydrocarbon oil with the solution of the viscosity improver and esterified polyalkylene glycol to form the lubricant composition, wherein said lubricant composition is a homogeneous solution.

19. The method of claim 18, wherein the amount of the polar viscosity improver present in the lubricant composition is greater than an amount that would be soluble in the base hydrocarbon oil in the absence of the esterified polyalkylene glycol.

20. The method of claim 18, the polar viscosity improver and esterified polyalkylene glycol is heated to a temperature from 40° C. to 100° C. during the dissolving.

* * * * *